US006202578B1

(12) United States Patent
Ruottu et al.

(10) Patent No.: US 6,202,578 B1
(45) Date of Patent: Mar. 20, 2001

(54) METHOD AND REACTOR FOR PROCESSING OF FUELS HAVING A WIDE PARTICLE SIZE DISTRIBUTION

(75) Inventors: Seppo Ruottu, Karhula; Markku Miettinen; Mauno Oksanen, both of Jyväskylä, all of (FI)

(73) Assignee: Vapo Oy (FI)

( * ) Notice: Subject to any disclaimer, the term of this patent is extended or adjusted under 35 U.S.C. 154(b) by 0 days.

(21) Appl. No.: 09/043,551

(22) PCT Filed: Sep. 30, 1996

(86) PCT No.: PCT/FI96/00514

§ 371 Date: Mar. 24, 1998

§ 102(e) Date: Mar. 24, 1998

(87) PCT Pub. No.: WO97/12177

PCT Pub. Date: Apr. 3, 1997

(30) Foreign Application Priority Data

Sep. 28, 1995 (FI) ..... 954595

(51) Int. Cl.[7] ..... F23D 1/02; F23B 5/00

(52) U.S. Cl. ..... 110/347; 110/348; 110/264; 110/265; 110/211

(58) Field of Search ..... 110/104 B, 260, 110/261, 262, 263, 264, 265, 102, 347, 348, 342, 208, 210, 212, 211, 213, 214

(56) References Cited

U.S. PATENT DOCUMENTS

| | | | | |
|---|---|---|---|---|
| 297,900 | * | 4/1961 | Sifrin | 110/266 X |
| 2,707,444 | * | 5/1955 | Van Loon | 110/266 X |
| 2,979,000 | * | 4/1961 | Sifrin et al. | 110/266 X |
| 3,357,383 | * | 12/1967 | Golovanov et al. | 110/266 |
| 3,856,455 | * | 12/1974 | Otway et al. | 110/264 X |
| 4,033,505 | * | 7/1977 | Lutes et al. | 110/264 X |
| 4,044,727 | * | 8/1977 | Rychen et al. | 122/449 |
| 4,057,021 | * | 11/1977 | Schoppe | 110/28 A |
| 4,147,116 | * | 4/1979 | Graybill | 110/263 |
| 4,326,702 | * | 4/1982 | Queneau et al. | 110/264 X |
| 4,565,137 | * | 1/1986 | Wright | 110/265 X |
| 4,584,948 | * | 4/1986 | Syred et al. | 110/264 |
| 4,586,443 | * | 5/1986 | Burge et al. | 110/264 X |
| 4,922,839 | * | 5/1990 | Boucher | 110/234 |
| 4,989,549 | * | 2/1991 | Korenberg | 110/264 X |
| 5,129,333 | * | 7/1992 | Frederick et al. | 110/235 |
| 5,549,059 | * | 8/1996 | Nechvatal et al. | 110/266 X |
| 5,697,306 | * | 12/1997 | LaRue et al. | 110/261 |

FOREIGN PATENT DOCUMENTS

| | | | | |
|---|---|---|---|---|
| 982412 | * | 1/1976 | (CA) | 110/266 |
| 1 096 531 | * | 1/1961 | (DE) . | |
| 0 525 734 A2 | * | 2/1993 | (EP) . | |
| 713080 | * | 10/1931 | (FR) . | |
| 115625 | * | 1/1946 | (SE) . | |
| 130548 C | * | 1/1951 | (SE) . | |

OTHER PUBLICATIONS

Derwent Abstract No. 89–157705/21, week 8921, of SU 1,437,614 (Moscow Power Institute, Nov. 1989) .*

* cited by examiner

*Primary Examiner*—Ira S. Lazarus
*Assistant Examiner*—Ljiljana V. Ciric
(74) *Attorney, Agent, or Firm*—Kilpatrick Stockton

(57) ABSTRACT

A method and reactor for processing fuels with a wide particle size distribution, particularly for flame combustion. The fuel is blown tangentially with the aid of an airflow into a swirl chamber containing a burning mass, thus creating a vortex, from the center of which a flow of material is led out of the swirl chamber. The vortex created by the feed of the fuel-air mixture and the diameter of the outlet flow are arranged to create a selective delay for coarse particles, so that the size of the particles is reduced, through mechanical treatment caused by evaporation, pyrolysis, and collision, to become smaller than the desired limit value, before they escape from the swirl chamber. The temperature of the cylindrical jacket of the swirl chamber is held below the melting point of the ash.

14 Claims, 3 Drawing Sheets

METHOD AND REACTOR FOR PROCESSING OF FUELS HAVING A WIDE PARTICLE SIZE DISTRIBUTION

The object of the invention is a method for processing, particularly for flame combustion, substances having a wide particle size distribution, in which method the fuel is blown, with the aid of a current of air, tangentially into a swirl chamber containing a burning mass thus creating a vortex, from the centre of which the flow of substances is led out of the swirl chamber. The invention is also concerned with a reactor for carrying out the method. Though the substances to be burned are generally granular solids, a low-grade liquid fuel may also be used. The reactor is usually part of the burner, but simple carburation may also be involved, for example in an industrial process.

Traditionally, the flame combustion of pulverized materials has been based on grinding the substance to be burned into a fine-particle dust, which is burned in a flame formed outside the actual burner. The greatest delay permitted by flame combustion, i.e. the time, in which a particle must be able to burn completely, is clearly less than 1 second, and is usually only a few tenths of a second. To stabilize the flame and maintain a reasonable length of flame, the substance to be burned must be ground to a size of less than 0.1 mm. Grinding has taken place in a separate mechanical mill. It is much more problematic to grind organic fuels to a particle size suitable for flame combustion than it is to grind coal, for example. Grinding organic fuels to suit dust combustion consumes 1–5 MJ/kg of energy, which is much too great to be economical. Milled peat must also be ground before it becomes suitable for flame combustion. Especially in small units, dust combustion that requires effective grinding has been economically uncompetitive, while in such units it has been also necessary to apply fluid bed combustion, which is quite expensive. It is even possible to say that the lack of a cheap solution to the combustion technique has been one factor weakening the economic competitiveness of peat and organic fuels.

A problem in dust combustion is the shortness of the reaction time of the particles, due to which the material to be burned must be very finely ground. Stability conditions in dust burners are strict, due to the very small mass of the ignition zone. Stable combustion also requires that the dust to be burned be adequately and evenly dry. For reasons of safety, dust burners must usually be safeguarded with a support flame using oil or gas. A dust combustion system thus requires the drying and grinding of the material to be burned, as well as stabilization burners and the dust burners proper. In small units, a system of this kind is not economically competitive.

One known combustion method that has also previously been quite widely applied in practice is so-called melt cyclone combustion. In cyclone burners, all the combustion air is brought to the cyclone and these generally operate at such a high temperature that the ash forming in the cyclone is removed in a molten state. Problems with cyclone burners have included the control of the temperature. Too low a temperature has led to the uncontrolled accumulation of a layer of slag on the walls of the cyclone, while at a high temperature the life of the protective lining of the cyclone has been too short. Due to the high temperature, emissions of nitrogenous gases from the cyclone burners have also been large and have exceeded permitted emission limits. For these reasons, cyclone combustion is scarcely ever used now.

Solutions to these costs and technical problems in dust and cyclone combustion have been sought in fluid-bed technology, among other things. Unfortunately, however, despite the development of fluid-bed technology, it seems that its economic competitiveness will remain poor in small units. Fluid-bed technology is divided into the so-called bubbling fluid bed (BFB) and circulating mass fluid bed (CFB) techniques. In the latter, a large flow of solids travels through the combustion chamber, and is separated in the cyclone and then returned to the lower section of the vertical combustion chamber. CFB combustion requires complicated equipment, which includes an air division chamber with a nozzle base, a vertical reaction chamber, a cyclone, and solids return equipment. CFB combustion is used to create a selective delay of coarse particles. In CFB combustion, the delay of the particles is primarily determined by the conditions in the vertical chamber (riser). The essential difference between CFB combustion and traditional cyclone combustion is in the quantity of solids stored in the system. In CFB combustion, the quantity of solids is much greater than in cyclone combustion, and almost without exception other solids besides the fuel are used in CFB combustion, these forming the greater part of the solids in the system. The large amount of solids is intended to improve the stability of the system and in some applications to reduce emissions too. CFB combustion will clearly not operate above the sintering temperatures of ash. In cyclone combustion, the quantity of solids is very small and the burners generally operate in the molten ash range. Both combustion techniques have obvious advantages and certain similarities. The question naturally arises whether it would be possible to combine the advantages of the simplicity of the equipment of cyclone combustion with the process-technical advantages of CFB combustion. This invention concerns a method in which the principal advantages of a CFB reactor are achieved in a simple swirl chamber. Low-grade liquid fuels are also a problem in combustion techniques. This invention is intended to solve these problems in the known technology.

Using the method according to the invention, it is possible to burn coarse particle solid substances and low-grade liquid fuels efficiently and at low cost. In the method according to the invention, a swirl chamber is used for the simultaneous chemical and physical processing of the material being processed. Later, the name Chemi Mechanical Reactor (CMR), which depicts its operation, will be used for the invention, which operates as follows. Coarse-particle fuel, together with a gas containing oxygen, is fed to the CMR. The ratio of oxygen and fuel is regulated, generally to a clearly sub-stoichiometric level, so that the temperature of the cylindrical jacket of the CMR settles to a most suitable level of 450–650° C. Air is most typically used as the gas containing oxygen, in which case the amount of the flow of air to be directed to the CMR is, for a dry fuel, 30–50% of the amount of air required for complete combustion. In a quite restricted area in the centre of the reactor, the temperature becomes much higher than in the cylindrical jacket, but this is not a problem. The oxidizing gas is brought to the CMR tangentially, so that a vortex is created in the CMR, preventing the coarse particles from escaping from the CMR. Because of this, solid material collects in the CMR and circulates as a band along the jacket of the CMR. Due to the internal turbulence in the CMR, the particles made friable by the temperature collide with one another and with the walls of the CMR and are thus ground into fine particles. In addition, pyrolysis and evaporation contribute to this phenomenon. When the particles go below a limit size that depends on their physical state, they leave the CMR. The vortex in the CMR is adjusted so that it permits the passage of particles whose reaction time in flame combustion is sufficiently small. In the CMR, the delay of large particles becomes great, whereas fine particulate material leaves the CMR quickly. A selective delay is obviously advantageous to combustion.

From the above, the following advantages are achieved in the CMR:

1. Due to the full adequate circulation of solids and to sub-stoichiometry, the temperature can be easily and precisely regulated.
2. The vortex of solids formed inside the CMR evens out circumferential differences in temperature and protect the structure from overheating.
3. The consumption of energy required for the grinding of the combustible material using chemical and thermal treatment becomes insignificantly small.
4. It is certain that the amount of solids collecting inside the CMR will stabilize the flame, making support combustion unnecessary.
5. A great output density ($MW/m^3$) is achieved inside the CMR.
6. Organically bound nitrogen is released under reduction conditions, so that the formation of nitrogen oxides is minimized.
7. The CMR can be implemented as an uncooled steel structure, without materials problems.

A burner according to the invention can also operate as a carburettor. It is then better to speak of a reactor, rather than a burner.

In what follows, the invention is illustrated with reference to the accompanying Figures, which present one burner according to the invention.

Figure 1:
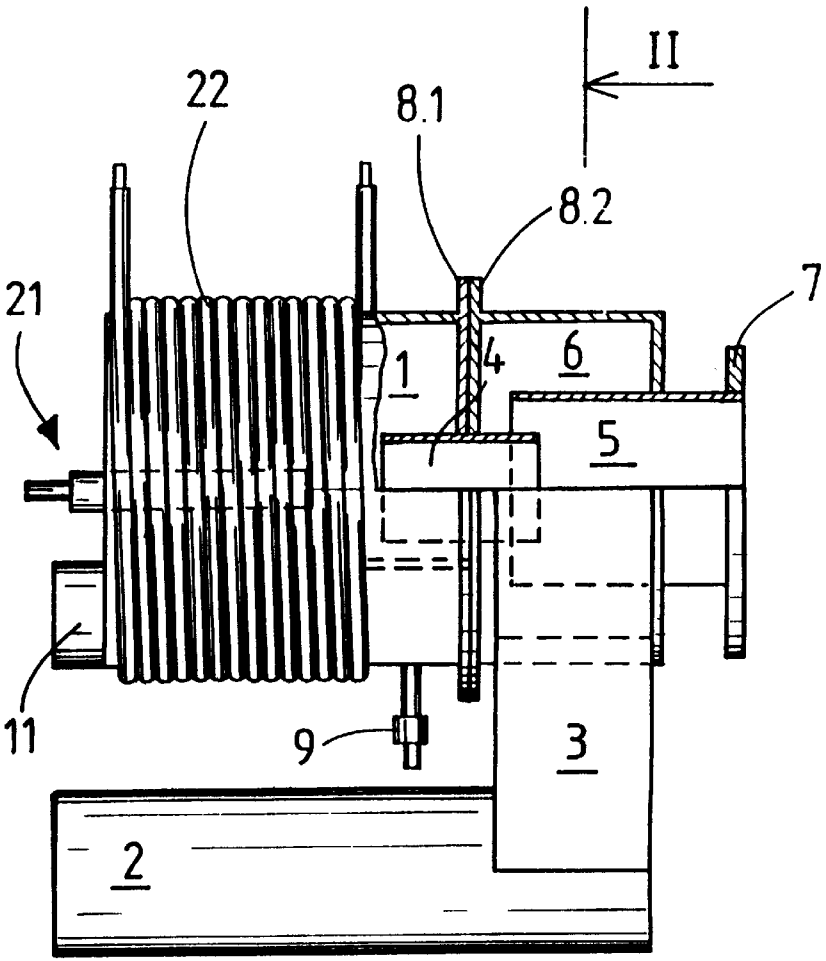
FIG. 1 shows a side view of the burner in partial cross-section.

Reference number 1 is used to mark the swirl chamber (CMR chamber), into which fuel is brought with the aid of supporting air from pipe 11 through connection 12, which is set tangentially to swirl chamber 1. At the end of swirl chamber 1 is a flange 8.1, by means of which it is attached to the end 8.2 of secondary chamber 6. Outlet duct 4 of the swirl chamber is set through these ends. It extends a short distance into secondary chamber 6, the outlet pipe of which, secondary duct 5, extends at the inner end partly on top of outlet duct 4, so that a ring-shaped gap is formed between them. Secondary air is brought through pipe 2 and connection 3, which is also set tangentially in the same direction as connection 12. The burner is attached, for example, to the wall of a boiler by flange 7.

To ignite the burner, there are electrical resistances 22 around the turbulence chamber 1, and an oil nozzle 9 of connection 12. Naturally, gas can also be used for ignition. In the centre of the front end of swirl chamber 1 there is a shield pipe 21, inside which a thermo-element itself is set to measure the temperature of swirl chamber 1 (CMR chamber).

Figure 2:
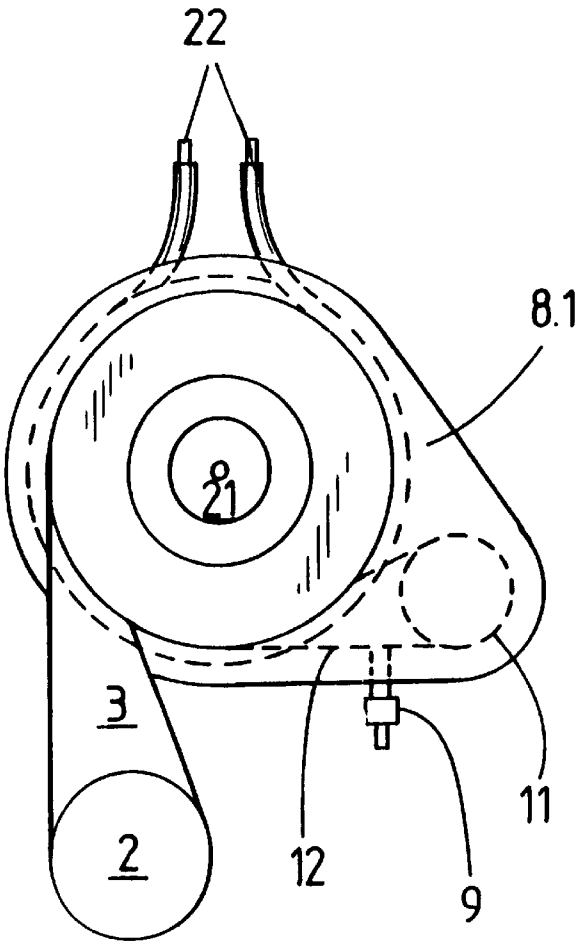
FIG. 2 shows a cross-section of the burner in FIG. 1 at II—II.
Figure 3:
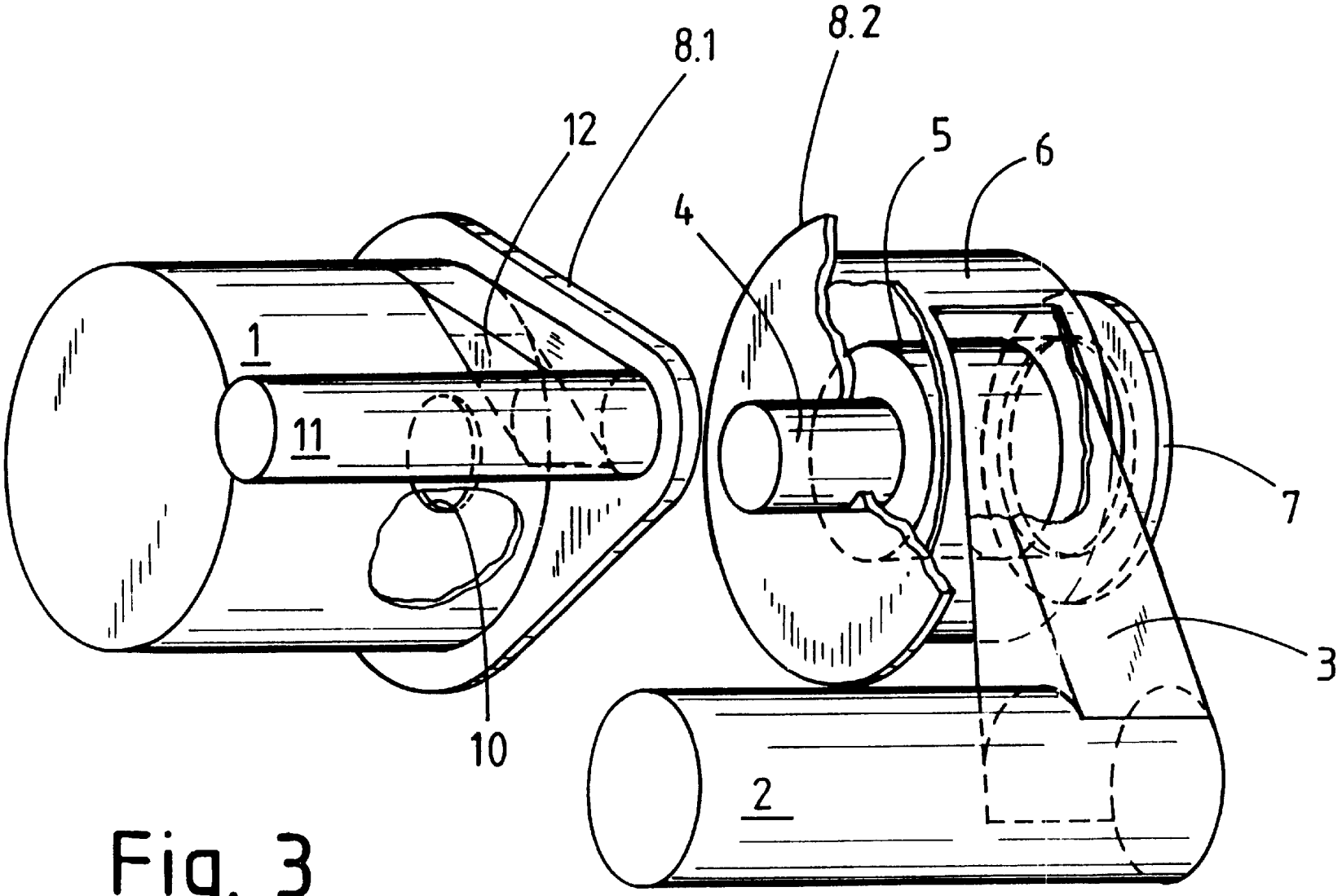
FIG. 3 shows components of the burner in an axonometric view.

In FIG. 3, the swirl chamber and the secondary air system are separated from each other and swirl chamber 1 has been rotated through about 90° in relation to the situation in FIGS. 1 and 2. Here connecting pipe 4 is attached to the flange 8.2 of secondary chamber 6, there being a hole 10 for this purpose in flange 8.1 of swirl chamber 1. FIG. 3 does not show the electrical resistances, the temperature sensor, or the ignition burner.

The principal dimensions of one pilot device (FIGS. 1–3) and a 2 MW (FIG. 4) burners are as follows:

| | Pilot | 2MW | Units |
|---|---|---|---|
| Diameter of CMR chamber | 200 | 895 | mm |
| Length of CMR chamber | 150 | 450 | mm |
| Diameter of Outlet pipe | 50 | 250 | mm |
| Height of inlet duct | | 23 | mm |
| Length of inlet duct | | 450 | mm |
| Properties of sawdust: | | | |
| Mass ratio of water/solids | 0.06 | 0.06 | |
| Maximum particle size | 5 | 5 | mm |
| Average particle size | 1 | 1 | mm |
| Airflow to CMR/stoichiometric airflow: | | | |
| Minimum | 0.4 | 0.35 | |
| Maximum | 1.2 | 1.2 | |
| Sawdust input: | | | |
| Maximum | 4.0 | 110 | g/s |
| Minimum | 1.7 | 20 | g/s |
| Minimum output density | 5 | 1.33 | $MW/m^3$ |
| Maximum output density | 11 | 6.6 | $MW/m^3$ |
| Length of flame: | | | |
| Maximum | 400 | | mm |
| Minimum | 150 | | mm |

The amount of air for sub-stoichiometric combustion in swirl chamber 1, i.e. in the CMR chamber, is controlled so that the temperature in the jacket settles to 450–650° C. This generally corresponds to 25–35% of the consumption of oxygen taking place in the swirl chamber. A temperature range of 450–550° C. is used with organic fuel, and a range of 550–650° C. is used with, for example, anthracite. It is essential that the secondary airflow is a concentric toroidal flow, most advantageously it is a vortical flow around the primary flow. It is also important that the secondary duct 5 is so close to end 8.2, that a pressure loss is created between them, which evens the toroidal flow.

The ratio of the length to the diameter of swirl chamber 1 (CMR chamber) is most advantageously 0.5–1.1. The length of the secondary chamber 6 is most advantageously 30–50% of the length of swirl chamber 1. The outlet duct 4 and the secondary chamber outlet pipe, secondary duct 5 most advantageously overlap by 20–30% of the diameter of the outlet duct. The diameter of the outlet duct 4 is most advantageously 25–35% of the diameter of swirl chamber 1. The outlet duct 4 extends advantageously also inside the swirl chamber 1 by 5–10% of its diameter, which particularly improves the selectivity of the swirl chamber.

Inside the swirl chamber, i.e. the CMR reactor, the question is not primarily of separation, but rather of the processing of solid particles into gas compounds and small coke particles. These all leave the swirl chamber through the outlet duct.

In certain cases using inert particulate material in the swirl chamber is advantageous, which improves the grinding of the solid fuel and increases the thermal capacity by evening combustion. The use of an inert substance can often be arranged so that only as much of it is fed in as leaves from the swirl chamber.

Figure 4:
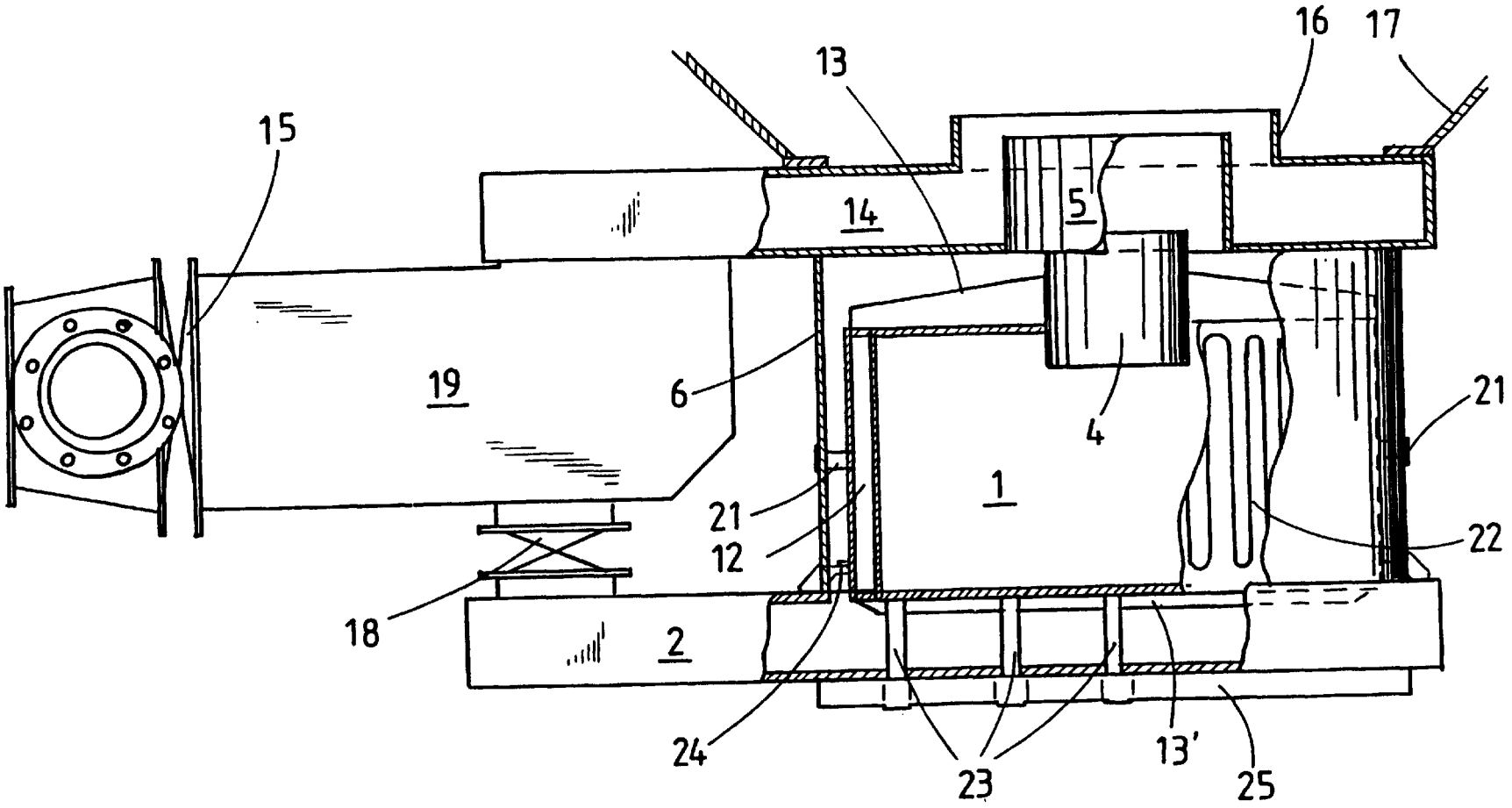
FIG. 4 shows a partial cross-section of another embodiment of a burner according to the invention.

FIG. 4 shows a larger output burner, which here is set vertically, when, besides the normal boiler structures, a second fluid bed can be set up, for example in a drier, which is located on top of the burner. The same reference numbers as above are used for components that are operationally similar. Thus, here too there is a swirl chamber 1 in the burner, its outlet duct 4, a feed duct 12, a secondary chamber 6, and a secondary duct 5. The swirl chamber 1, the outlet duct 4, the secondary chamber 6, the secondary duct 5, and the collar 16 described later are all concentric cylindrical components. Here the burner is set on the base of the firebox 17 of the boiler or similar.

Fuel is blown, by means of a controlled amount of air, from the inlet connection 12 tangentially into the swirl chamber 1. Here the inlet connection 12 is the length of the chamber and its radial extent is 2.6% of the diameter. The radial extent is advantageously 2–4%. The angular momentum of the fuel flow and the geometry of the chamber determine the delay time, which further determine the size of the escaping particles. The larger the size of the escaping particles, the longer the flame created. According to a typical criterion, the maximum size of the escaping particles is 0.1 mm, in which case the length of the flame remains reasonable.

Differing from the previous application, in this totality the secondary chamber 6 surrounds swirl chamber 1 and secondary blowing is guided to scavenge the outer surfaces of the swirl chamber 1. Operationally, a similar gap to that above remains in the area of mutual overlapping between the outlet duct 4 of the swirl chamber 1 and the secondary duct 5 of the secondary chamber 6. Secondary blowing is directed through this ring-shaped gap as a vortical flow around the main flow. Here too, the secondary blowing creates angular momentum with the aid of wings 13. Eight wings are welded to the outer end of the swirl chamber at an angle of 23° to the radius. These give the secondary blowing a rotation with the same direction as that of the main flow of the outlet duct 4. On the other side, the wings 13' even out the blowing above the swirl chamber 1.

The swirl chamber 1 is supported from the secondary chamber 6 on four retainers 24. In addition, the swirl chamber 1 supports lugs 21, inside which sensors are placed to measure the temperature of the jacket. The burner can be dismantled from below by opening hatch 25, through which swirl chamber 1 can be removed. Connections 23 in the end of the swirl chamber, which can be used to measure temperature or through which ash can be removed, extend to hatch 25.

The secondary airflow of duct 19 is divided here into two parts, so that secondary air is led through valve 18 to distribution duct 2, to which secondary chamber 6 is connected, while the secondary air is distributed in the manner described above. Air is also led from distribution duct 19 to duct 14, which has a ring-shaped opening between collar 16 and secondary duct 5. A third toroidal flow is blown from this.

During start-up, valve 18 is closed and the swirl chamber is heated by means of resistances 22, when it is possible to ignite the flow of fuel using an auxiliary flame. After this, the temperature of the swirl chamber 1 is adjusted on the one hand by adjusting valve 18 and on the other by controlling the fuel-air ratio. The total secondary airflow is controlled using valve 15.

In one loading situation, 1.2, MW output was obtained from the burner when the input consisted of 65 g/s of sawdust with a moisture content of 10%, 200 g/s of primary air, and 2.6 kg/s (total) of secondary air. The stoichiometric amount of air would have been only 0.37 kg/s, but in this case the burner was also connected to a fuel dryer. The flow velocity of the input air was about 16 m/s.

The adjustment values of the burner are determined by, among other things, the length that the flame is set to. This sets the limit value for the maximum size of the particles escaping from the swirl chamber. The fuel particles must then be given such a great angular momentum, that the large particles remain in the swirl chamber for a sufficient length of time and that when colliding and burning during this time they reach the maximum size permitted.

In some embodiments, the set criterion is easily fulfilled, in which case the air can be fed to the swirl chamber separately and the fuel feed can be to some extent fragmentary.

What is claimed is:

1. A method for processing fuel with a wide particle size distribution, in which the fuel is blown tangentially with an airflow into a swirl chamber (1) having a cylindrical jacket and containing a burning mass, thus creating a vortex, comprising:

leading an outlet flow of the burning mass out from the center of the swirl chamber;

arranging the vortex created by the blown fuel-air mixture and by a diameter of the outlet flow to create a selective delay for relatively coarse particles, so that the size of the relatively coarse particles is reduced through mechanical treatment caused by evaporation, pyrolysis, and collision, to become smaller than a desired limit value, before the particles escape from the swirl chamber, and;

holding the temperature of the cylindrical jacket of the swirl chamber below the melting point of ash from burning of the fuel, and wherein the flow of air is divided into at least two stages, in a first stage of which the fuel to be burned is fed to the swirl chamber with a sub-stoichiometric amount of air, and in a subsequent stage of which a secondary airflow is added as a concentric toroidal flow around the outlet flow leaving the swirl chamber.

2. A method according to claim 1, characterized in that the secondary airflow is formed into a vortex that is concentric and parallel to the primary airflow.

3. A method according to claim 2, characterized in that the second airflow is led over the swirl chamber (1) to cool the swirl chamber.

4. A method according to claim 1, characterized in that the temperature of the cylindrical jacket of the swirl chamber (1) is maintained in a range of 450 to 650° C.

5. A method according to claim 1, characterized in that inert particulate material is also fed to the swirl chamber (1).

6. A reactor for flame combustion of solid substances with a wide particle size distribution, the reactor comprising:

a substantially cylindrical swirl chamber (1) with tangential fuel and air connections (11) and a central outlet duct (4) of substantially smaller diameter than that of the swirl chamber;

the fuel and air connections of the swirl chamber being common in order to use an entire primary blowing of fuel and air into the swirl chamber to create angular momentum in the fuel;

the reactor having a secondary chamber (6) equipped with a secondary duct that is concentric to an outlet duct (4) and greater in diameter than the outlet duct (4), the secondary duct being arranged concentrically in an end of the swirl chamber (1) so that the outlet duct (4) extends a short distance into the secondary chamber (6) and the secondary duct (5) extends from a direction opposite to the outlet duct and surrounding a portion of the outlet duct (4) so as to form a ring-shaped gap into which secondary air is fed from the secondary chamber into the secondary duct around the main airflow from the outlet duct (4).

7. A reactor according to claim 6, characterized in that the length and diameter of the swirl chamber (1) having a ratio of 0.5 to 1.1.

8. A reactor according to claim 6, characterized in that the diameter of the outlet duct (4) is equal to 25 to 35% of the diameter of the swirl chamber (1).

9. A reactor according to claim 6, characterized in that the outlet duct (4) extends inside swirl chamber (1) by a distance equal to 5 to 10% of the diameter of the swirl chamber (1).

10. A reactor according to claim 8, characterized in that the outlet duct (4) extends inside swirl chamber (1) by a distance equal to 5 to 10% of the diameter of swirl chamber (1).

11. A reactor according to claim 6, characterized in that the secondary chamber surrounds the swirl chamber, thus cooling it.

12. A reactor according to claim 6, further comprising an air pipe (2) connected to supply air to the secondary chamber, and characterized in that the outlet duct (4) and the secondary duct (5) of the secondary chamber overlap by a distance equal to 20 to 30% of the diameter of the outlet duct.

13. A reactor according to claim 12, characterized in that the radial extent of the fuel and air connection (12) is equal to 2 to 4% of the diameter of the swirl chamber.

14. A reactor according to claim 6, characterized in that the length of the common fuel and air connections are the same as the axial length of the entire swirl chamber.

* * * * *